US007681982B2

(12) United States Patent
Suzuki

(10) Patent No.: US 7,681,982 B2
(45) Date of Patent: Mar. 23, 2010

(54) INK JET RECORDING APPARATUS

(75) Inventor: Tomoji Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 658 days.

(21) Appl. No.: 11/505,093

(22) Filed: Aug. 15, 2006

(65) Prior Publication Data

US 2007/0035578 A1 Feb. 15, 2007

(30) Foreign Application Priority Data

Aug. 15, 2005 (JP) ..... 2005-235507

(51) Int. Cl.
*B41J 2/165* (2006.01)

(52) U.S. Cl. ..... 347/36

(58) Field of Classification Search ..... 347/3, 347/37, 49, 85, 86, 89, 93
See application file for complete search history.

(56) References Cited

U.S. PATENT DOCUMENTS

| | | | | |
|---|---|---|---|---|
| 4,524,365 | A * | 6/1985 | Kakeno et al. | 347/86 |
| 5,929,883 | A * | 7/1999 | Gunther et al. | 347/85 |
| 6,281,911 | B1 | 8/2001 | Nakazawa et al. | |
| 6,328,415 | B1 * | 12/2001 | Norton et al. | 347/37 |
| 6,481,829 | B1 * | 11/2002 | Bailey et al. | 347/49 |
| 7,018,027 | B2 | 3/2006 | Harada et al. | |
| 2005/0036015 | A1 | 2/2005 | Seino et al. | |
| 2005/0041075 | A1 * | 2/2005 | Fujioka | 347/85 |
| 2005/0052511 | A1 | 3/2005 | Seino et al. | |
| 2005/0068382 | A1 | 3/2005 | Kimura et al. | |
| 2005/0116998 | A1 | 6/2005 | Harada et al. | |
| 2005/0162494 | A1 | 7/2005 | Inokuchi et al. | |
| 2005/0174402 | A1 * | 8/2005 | Yamada et al. | 347/86 |
| 2005/0185036 | A1 | 8/2005 | Seino et al. | |
| 2005/0248637 | A1 | 11/2005 | Seino et al. | |

FOREIGN PATENT DOCUMENTS

| | | |
|---|---|---|
| JP | 11-70672 | 3/1999 |
| JP | 2000-108378 | 4/2000 |
| JP | 2004-345246 | 12/2004 |
| JP | 2005-59317 | 3/2005 |
| JP | 2005-74749 | 3/2005 |

* cited by examiner

*Primary Examiner*—Stephen D Meier
*Assistant Examiner*—Alexander C Witkowski
(74) *Attorney, Agent, or Firm*—Nutter McClennen & Fish LLP; John J. Penny, Jr.

(57) ABSTRACT

An ink jet recording apparatus including: a cartridge mounting portion, on which an ink cartridge having a waste ink containing portion containable a waste ink can be mounted; a waste ink introduction portion, adapted to connect to a waste ink introduction port of the waste ink containing portion of the ink cartridge so as to introduce the waste ink; a waste ink introduction portion holder, supporting the waste ink introduction portion; and a cartridge moving mechanism, operable to move the ink cartridge to a cartridge replacement position, located on an outside of the cartridge mounting portion where the ink cartridge can be attached to or detached from the cartridge mounting portion, and a cartridge use position located on an inside of the cartridge mounting portion, wherein the waste ink introduction portion holder is constructed to move integrally with the ink cartridge between the cartridge replacement and the cartridge use position while the waste ink introduction portion is connected to the waste ink introduction port.

18 Claims, 9 Drawing Sheets

INK JET RECORDING APPARATUS

BACKGROUND OF THE INVENTION

1. Technical Field of the Invention

The present invention relates to an ink jet recording apparatus that has an ink supply needle, which is inserted into and connected to an ink outlet port of an ink cartridge, and a waste ink introduction needle, which is inserted into and connected to a waste ink introduction port of the ink cartridge, in a cartridge mounting portion, on which the ink cartridge is mounted.

2. Description of the Related Art

In an ink jet recording apparatus, waste ink that does not contribute to recording (printing) occurs at the time of a head cleaning operation of a printing head that is performed so as to prevent degradation of printing quality due to ink clogging or an ink filling operation after replacement of an ink cartridge. A waste ink storage structure that collects waste ink is required so as to prevent waste ink from being unexpectedly stuck to a mechanism in the ink jet recording apparatus or the like.

An ink jet recording apparatus having the following configuration (for example, see JP-A-11-70672) has been suggested. That is, in an ink cartridge that is detachably mounted on the ink jet recording apparatus, a waste ink storage space in which an ink absorption member for absorbing waste ink is installed, and a waste ink introduction port for receiving waste ink to the waste ink storage space from the outside are added. Further, in a cartridge mounting portion, on which the ink cartridge is mounted, an ink supply needle that is inserted into and connected to an ink outlet port of the ink cartridge, and a waste ink introduction port that is inserted into and connected to the waste ink introduction port of the ink cartridge are provided.

In such an ink jet recording apparatus, a cap that covers a printing head and receives waste ink to be discharged from a printing head at the time of a head cleaning operation of the printing head or an ink filling operation after replacement of the ink cartridge is provided. Further, in the cap, a waste ink feeding pump that discharges waste ink discharged from the printing head from the cap is provided. An outlet port of the waste ink feeding pump is connected to the waste ink introduction needle through a flexible waste ink feeding tube, and thus waste ink is collected into the waste ink storage space of the ink cartridge, to which the waste ink introduction needle is connected.

By the way, in the ink jet recording apparatus that uses the ink cartridge having the waste ink storage space described above, when the waste ink feeding pump operates for the head cleaning operation or the like, the ink cartridge may be unexpectedly removed, and the waste ink introduction needle may be separated from the waste ink introduction port of the ink cartridge. Accordingly, waste ink to be discharged by the waste ink feeding pump may flow into the apparatus, and the inside of the apparatus may be severely damaged.

In order to minimize such damages, up to the present, a cartridge attachment/detachment detecting sensor that detects when a mounting portion opening/closing cover that covers the front surface of the cartridge mounting portion is opened or when the user starts to move the ink cartridge in an ejection direction thereof after the mounting portion opening/closing cover is opened is provided. Then, when the above-described operations are detected, the operation of the waste ink feeding pump immediately stops.

However, even when the waste ink feeding pump stops, waste ink is filled into and remains in a flow passage from the waste ink feeding pump to the waste ink introduction needle at that time. Accordingly, if the waste ink introduction needle is separated from the ink cartridge immediately after the waste ink feeding pump stops, waste ink remaining in the flow passage flows into the apparatus, and thus the inside of the apparatus is stained.

SUMMARY OF THE INVENTION

Accordingly, it is an object of at least one embodiment of the invention to provide an ink jet recording apparatus that, even though replacement of an ink cartridge that is receiving waste ink fed from a waste ink feeding pump during an operation of the waste ink feeding pump is performed, can prevent waste ink, that remains in a flow passage from the waste ink feeding pump to the ink cartridge, from leaking into the apparatus and from staining the inside of the apparatus.

According to an aspect of the at least one embodiment of the invention, an ink jet recording apparatus comprising: a cartridge mounting portion, on which an ink cartridge having a waste ink containing portion containing a waste ink can be mounted; a waste ink introduction portion, adapted to connect to a waste ink introduction port of the waste ink containing portion of the ink cartridge so as to introduce the waste ink; a waste ink introduction portion holder, supporting the waste ink introduction portion; and a cartridge moving mechanism, operable to move the ink cartridge to a cartridge replacement position, located on an outside of the cartridge mounting portion where the ink cartridge can be attached to or detached from the cartridge mounting portion, and a cartridge use position located on an inside of the cartridge mounting portion, wherein the waste ink introduction portion holder is constructed to move integrally with the ink cartridge between the cartridge replacement and the cartridge use position while the waste ink introduction portion is connected to the waste ink introduction port.

According to another aspect of the at least one embodiment of the invention, an ink jet recording apparatus comprising: an ink supply portion, adapted to connect to an ink outlet port of an ink cartridge so as to supply ink of the ink cartridge to a printing head; a waste ink introduction portion, adapted to connect to a waste ink introduction port of the ink cartridge; a waste ink introduction portion holder, supporting the waste ink introduction portion; and a cartridge moving mechanism, operable to move the ink cartridge from a cartridge replacement position where the ink outlet port and the ink supply portion are disconnected from each other, to a cartridge use position where the ink outlet port and the ink supply portion are connected to each other, or from the cartridge use position to the cartridge replacement position, wherein the waste ink introduction portion holder is constructed to move integrally with the ink cartridge between the cartridge replacement position and the cartridge use position while the waste ink introduction portion is connected to the waste ink introduction port is provided.

According to these configurations, at the time of the replacement of the ink cartridge, if the cartridge moving mechanism is first driven by an operation or the like, a used ink cartridge that is mounted on the cartridge mounting portion is extracted to the cartridge replacement position where the connection to the ink supply needle is released. At that time, even if the ink cartridge moves to the cartridge replacement position, the waste ink introduction portion holder of the cartridge mounting portion that introduces waste ink into the waste ink storage space of the ink cartridge moves integrally with the ink cartridge to the cartridge replacement position. Therefore, until a removal operation of the ink cartridge from the cartridge replacement position is made, the waste ink introduction needle or the waste ink introduction portion formed of such as a porous material is not separated from the waste ink introduction port of the ink cartridge.

That is, even though the ink cartridge starts to move from the cartridge use position toward the cartridge replacement position for the sake of the replacement of the ink cartridge, the waste ink introduction portion is not separated from the ink cartridge immediately after the start of the movement. The connection state of the ink cartridge and the waste ink introduction portion is maintained until the ink cartridge is removed from the cartridge replacement position.

Therefore, a required time when the connection of the ink cartridge and the waste ink introduction portion is released can be significantly increased, as compared with the related art in which the connection of the ink cartridge and the waste ink introduction portion is released immediately after the ink cartridge starts to move from the cartridge use position toward the cartridge replacement position.

In case where a sensor that detects the start of the movement of the ink cartridge is provided, and the waste ink feeding pump is configured so as to stop when the ink cartridge starts to move, even though the replacement of the ink cartridge, which is receiving waste ink fed from the waste ink feeding pump, starts during the operation of the waste ink feeding pump, a sufficient time elapses from a time when the operation of the waste ink feeding pump stops until the ink cartridge reaches the cartridge replacement position and is removed from the cartridge replacement position is allocated to a time for collecting waste ink remaining in a flow passage from the waste ink feeding pump to the waste ink introduction needle into the waste ink storage space of the ink cartridge. Therefore, there seldom occurs a situation in which waste ink remaining in the flow passage is not collected and leaks into the apparatus, and the inside of the apparatus can be prevented from being stained due to waste ink.

The ink jet recording apparatuses according to the at least one embodiment of the invention may further include a cartridge movement detecting sensor operable to detect a movement operation of the ink cartridge from the cartridge use position to the cartridge replacement position based on a displacement operation of the cartridge attachment/detachment lever, wherein when the movement operation of the ink cartridge is detected by the cartridge movement detecting sensor, an operation of a waste ink feeding pump to feed the waste ink to the waste ink introduction needle may stop.

According to this configuration, when the replacement of the ink cartridge, which is receiving waste ink fed from the waste ink feeding pump, starts during the operation of the waste ink feeding pump, the cartridge attachment/detachment lever may be displaced in order to move the ink cartridge from the cartridge use position to the cartridge replacement position in the cartridge mounting portion. With this configuration, the operation of the waste ink feeding pump stops immediately after the displacement of the cartridge attachment/detachment lever starts. Subsequently, a sufficient time elapsed until the ink cartridge reaches the cartridge replacement position and is removed from the cartridge replacement position is allocated to a time for collecting waste ink remaining in the flow passage from the waste ink feeding pump to the waste ink introduction needle into the waste ink storage space of the ink cartridge. Therefore, the situation in which waste ink remaining in the flow passage is not collected and leaks into the apparatus rarely occurs, and the inside of the apparatus can be prevented from being stained due to waste ink.

In the ink jet recording apparatuses according to at least one embodiment of the invention, the cartridge moving mechanism may have a locking mechanism that fixes the waste ink introduction portion holder at the cartridge replacement position.

According to this configuration, the replacement of the ink cartridges is performed while the locking mechanism fixes the waste ink introduction portion holder at the cartridge replacement position. Therefore, the handling property of the replacement can be improved.

In the ink jet recording apparatus according to the at least one embodiment of the invention, a displacement operation of the cartridge attachment/detachment lever, when the ink cartridge moves from the cartridge use position to the cartridge replacement position, includes a predetermined operation range at the beginning thereof set such that the displacement operation does not move the ink cartridge and the waste ink introduction portion holder.

According to this configuration, immediately after the displacement operation of the cartridge attachment/detachment lever starts, the actual movement of the ink cartridge to the cartridge replacement position starts later than the displacement operation of the lever by an amount of time equal to the idle time of the operation of the lever. Therefore, a required time until the connection of the ink cartridge and the waste ink introduction needle is released can be increased.

That is, the time for collecting waste ink remaining in the flow passage from the waste ink feeding pump to the waste ink introduction needle into the waste ink storage space can be delayed. Therefore, the collection of waste ink remaining in the flow passage can be reliably performed, and thus reliability for a leakage prevention effect of waste ink can be improved.

The ink jet recording apparatuses according to the at least one embodiment of the invention may further include a mounting portion opening/closing cover which, when open, covers a front surface of the cartridge mounting portion, wherein the displacement operation of the cartridge attachment/detachment lever operates in conjunction with an opening/closing operation of the mounting portion opening/closing cover.

According to this configuration, the opening/closing operation of the mounting portion opening/closing cover also includes the displacement operation of the cartridge attachment/detachment lever. The replacement operation of the ink cartridge includes (a) opening the mounting portion opening/closing cover and extracting the ink cartridge mounted on the cartridge mounting portion to the cartridge replacement position; and (b) replacing the ink cartridge extracted to the cartridge replacement position with a new ink cartridge and closing the mounting portion opening/closing cover. Therefore, as compared with the related art in which the opening/closing operation of the mounting portion opening/closing cover and the displacement operation of the cartridge attachment/detachment lever are separately performed, the replacement of the ink cartridge can be performed by the small amount of action, and a handling property can be improved.

In the ink jet recording apparatus according to the embodiment of the invention, even though the ink cartridge in the cartridge mounting portion is extracted to the cartridge replacement position for the replacement of the ink cartridge, unless the ink cartridge is removed from the cartridge replacement position, there is no case where the waste ink introduction portion, such as the waste ink introduction needle or the like, is separated from the ink cartridge. In addition, the required time until the connection of the ink cartridge and the waste ink introduction portion is released can be significantly increased.

For this reason, if the waste ink feeding pump is configured so as to rapidly stop when the ink cartridge starts to move, even though the replacement of the ink cartridge starts during the operation of the waste ink feeding pump, a sufficient time from the time when the operation of the waste ink feeding pump stops until the connection of the ink cartridge and the waste ink introduction portion is released can be secured. Then, waste ink remaining in the flow passage from the waste ink feeding pump to the waste ink introduction needle can be collected into the ink cartridge for that time.

Therefore, that the situation in which waste ink remaining in the flow passage is not collected and leaks into the apparatus rarely occurs. As a result, the inside of the apparatus can be prevented from being stained due to waste ink.

DETAILED DESCRIPTION OF THE INVENTION

An ink jet recording apparatus according to an embodiment of the invention will now be described with reference to the drawings.

Figure 1:
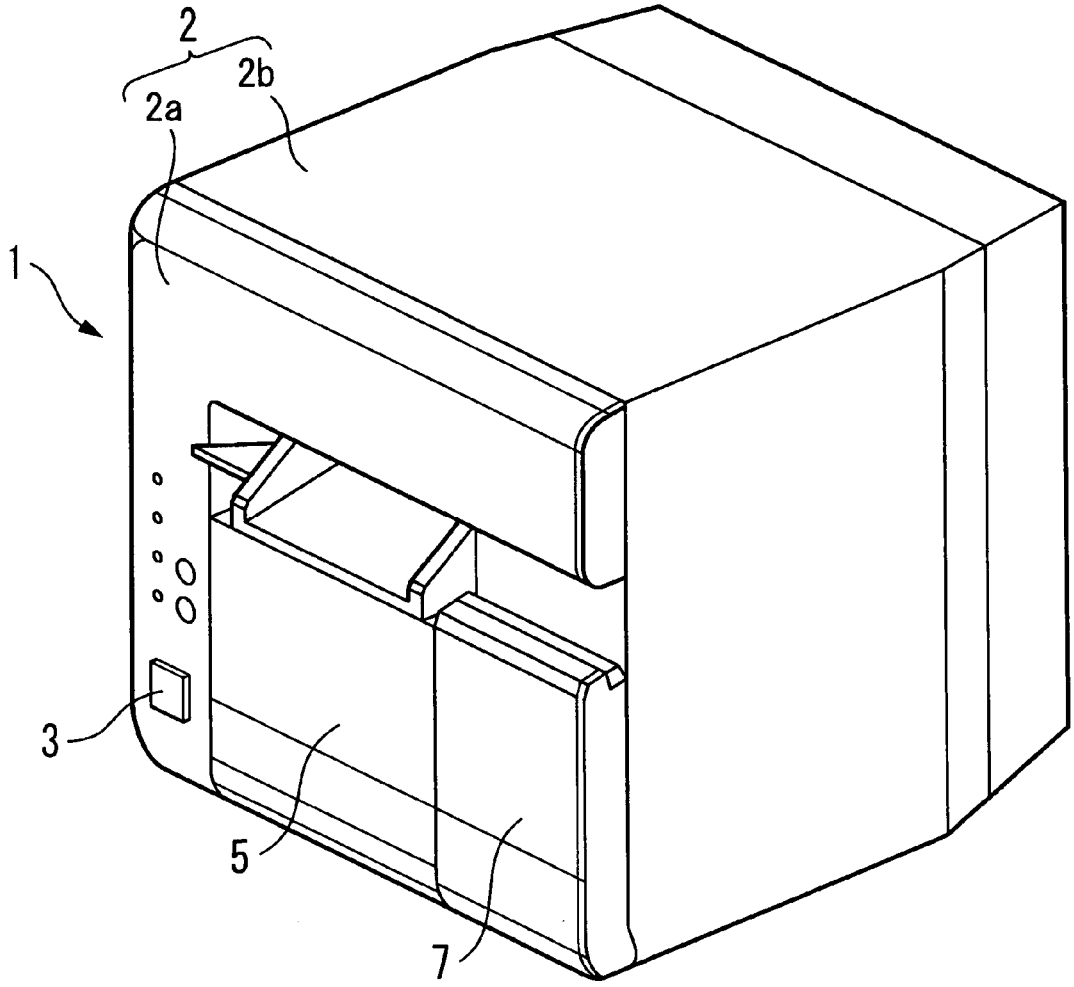
FIG. 1 is an exterior perspective view of an ink jet recording apparatus according to an embodiment of the invention.
Figure 2:
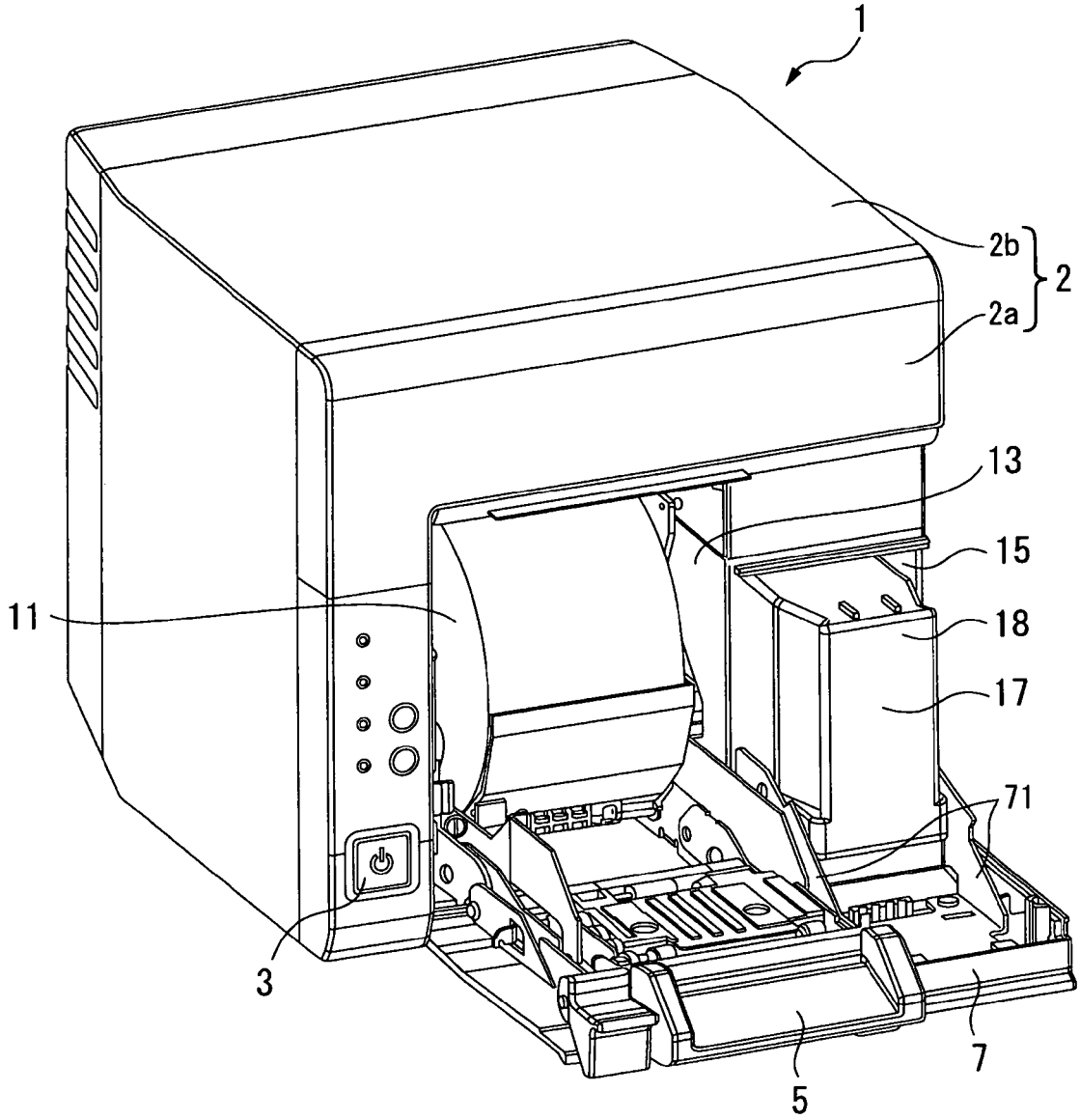
FIG. 2 is a perspective view showing a state where a roll paper cover and a mounting portion opening/closing cover of the ink jet recording apparatus shown in FIG. 1 are opened.
Figure 3:
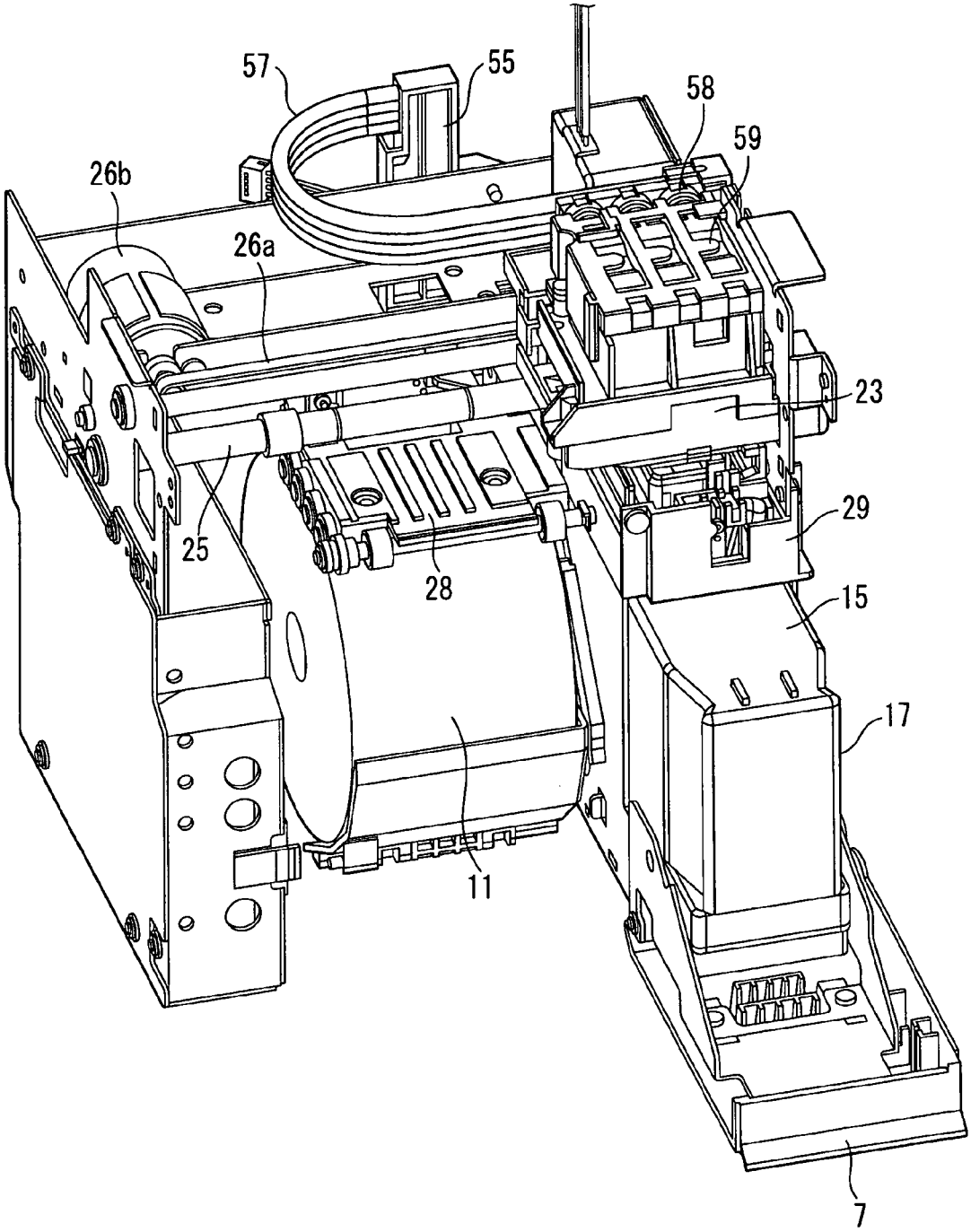
FIG. 3 is a perspective view showing a state where a case is removed from the ink jet recording apparatus shown in FIG. 2.
Figure 4:
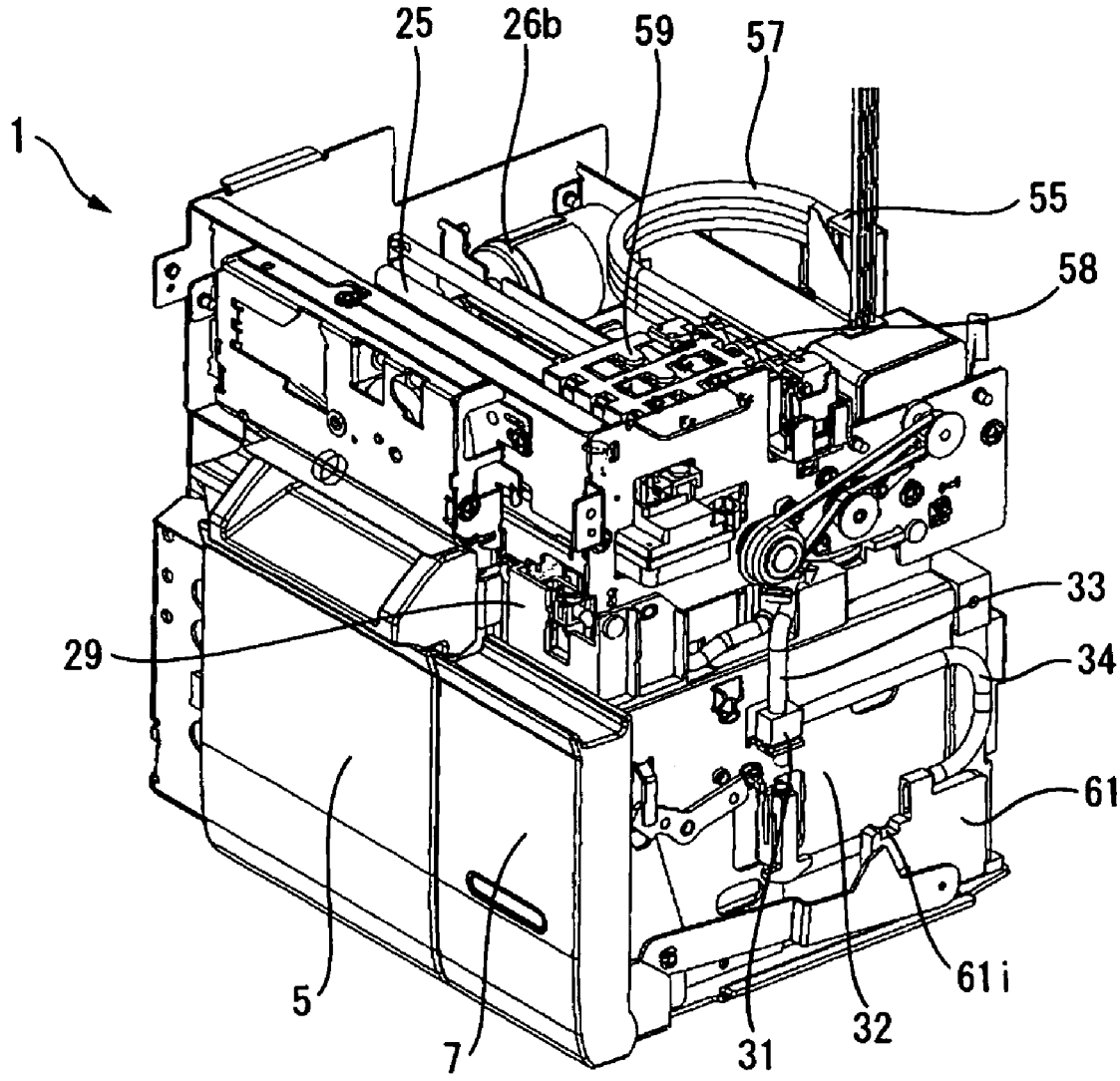
FIG. 4 is a perspective view showing a state where a front upper panel, a case cover, and so on of the ink jet recording apparatus shown in FIG. 1 are removed.
Figure 5:
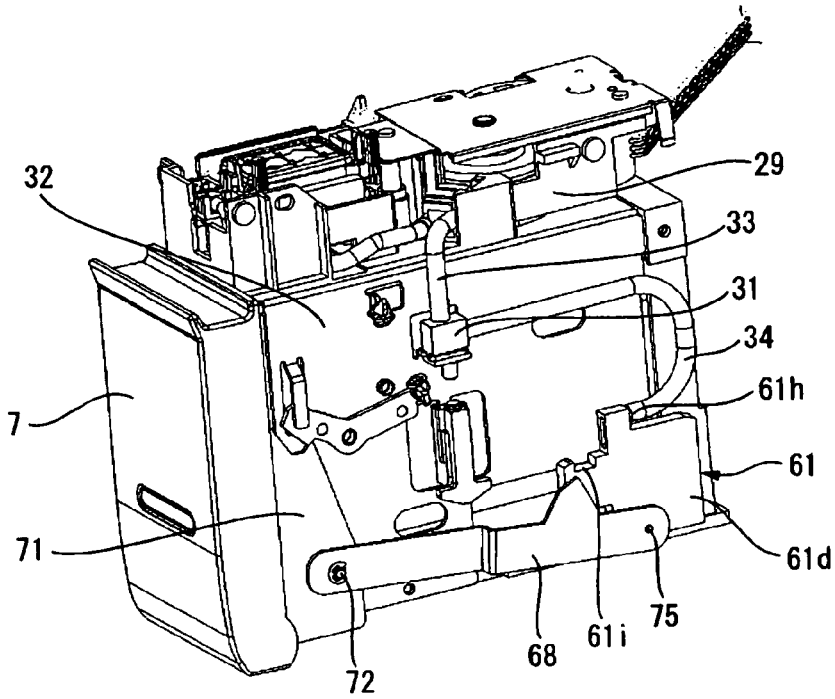
FIG. 5 is an expanded perspective view of a cartridge mounting portion shown in FIG. 4.
Figure 6:
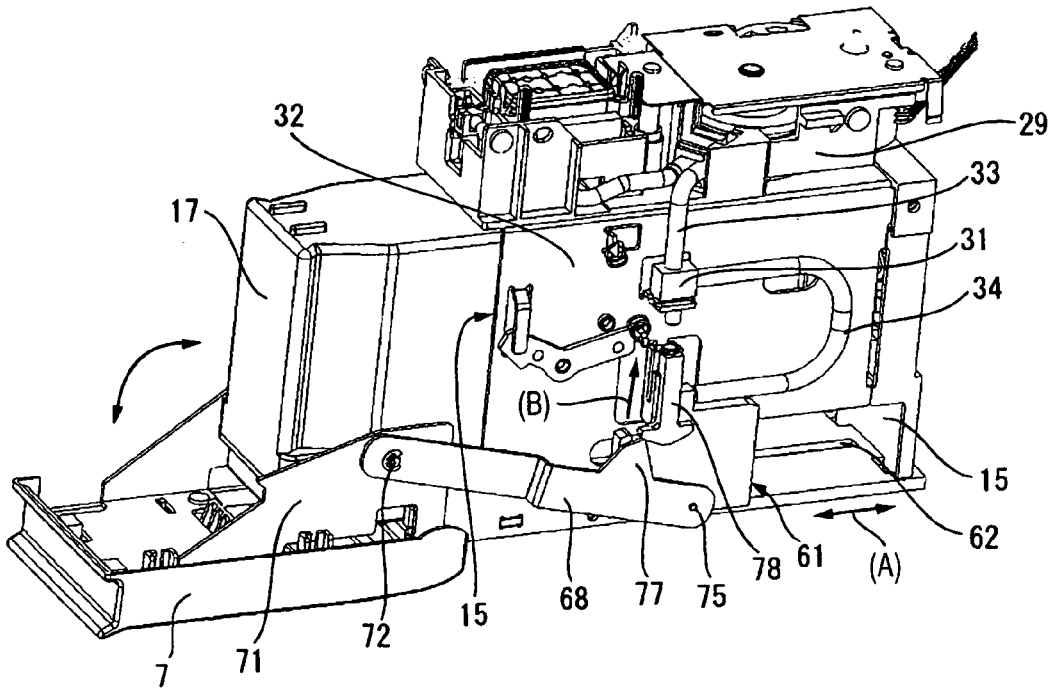
FIG. 6 is a perspective view showing a state where a mounting portion opening/closing cover of the cartridge mounting portion shown in FIG. 5 is opened.
Figure 7:
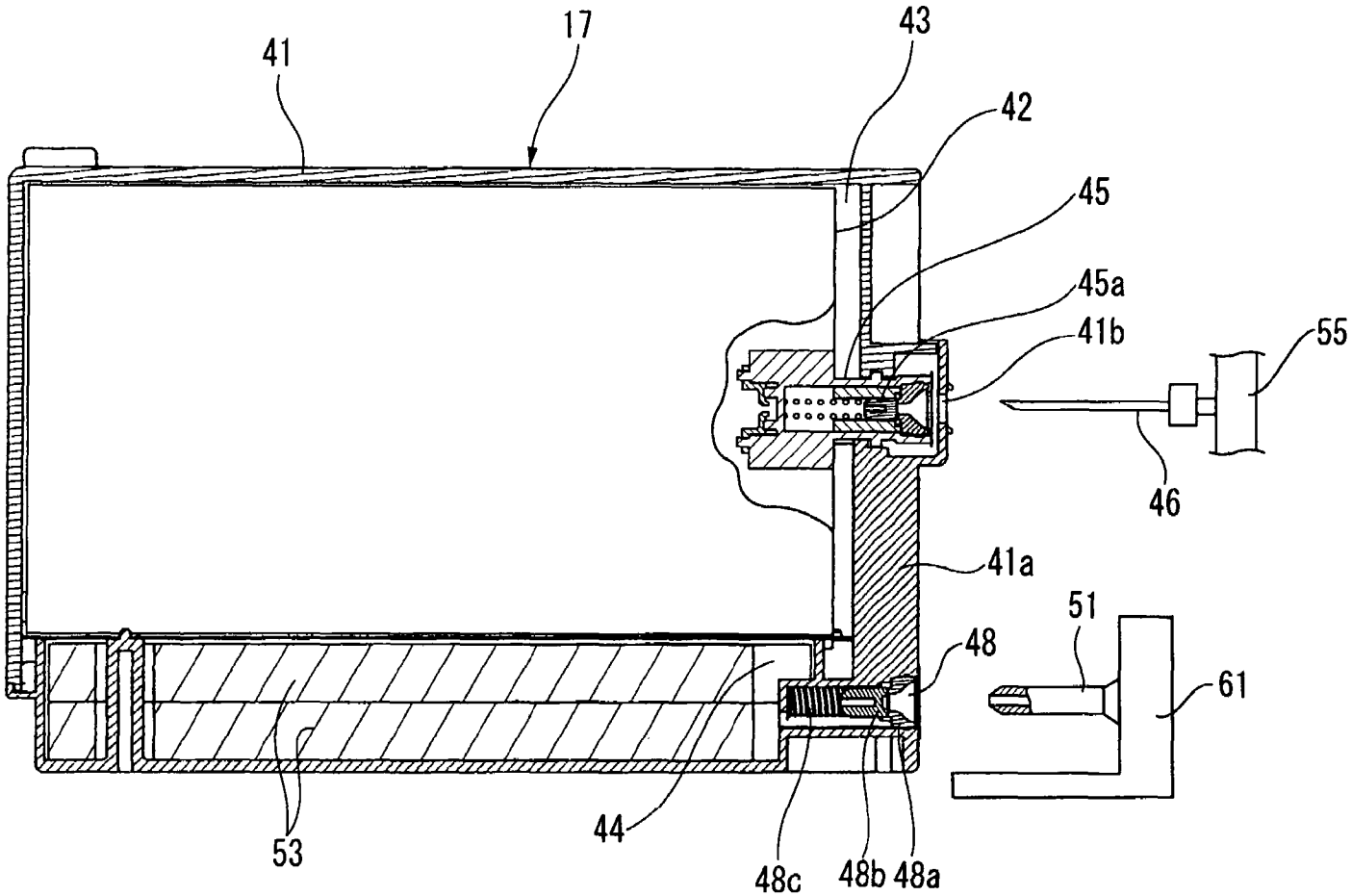
FIG. 7 is a longitudinal cross-sectional view showing the positional relationship between an ink cartridge and a. waste ink introduction needle to be connected to the ink cartridge.
Figure 8:
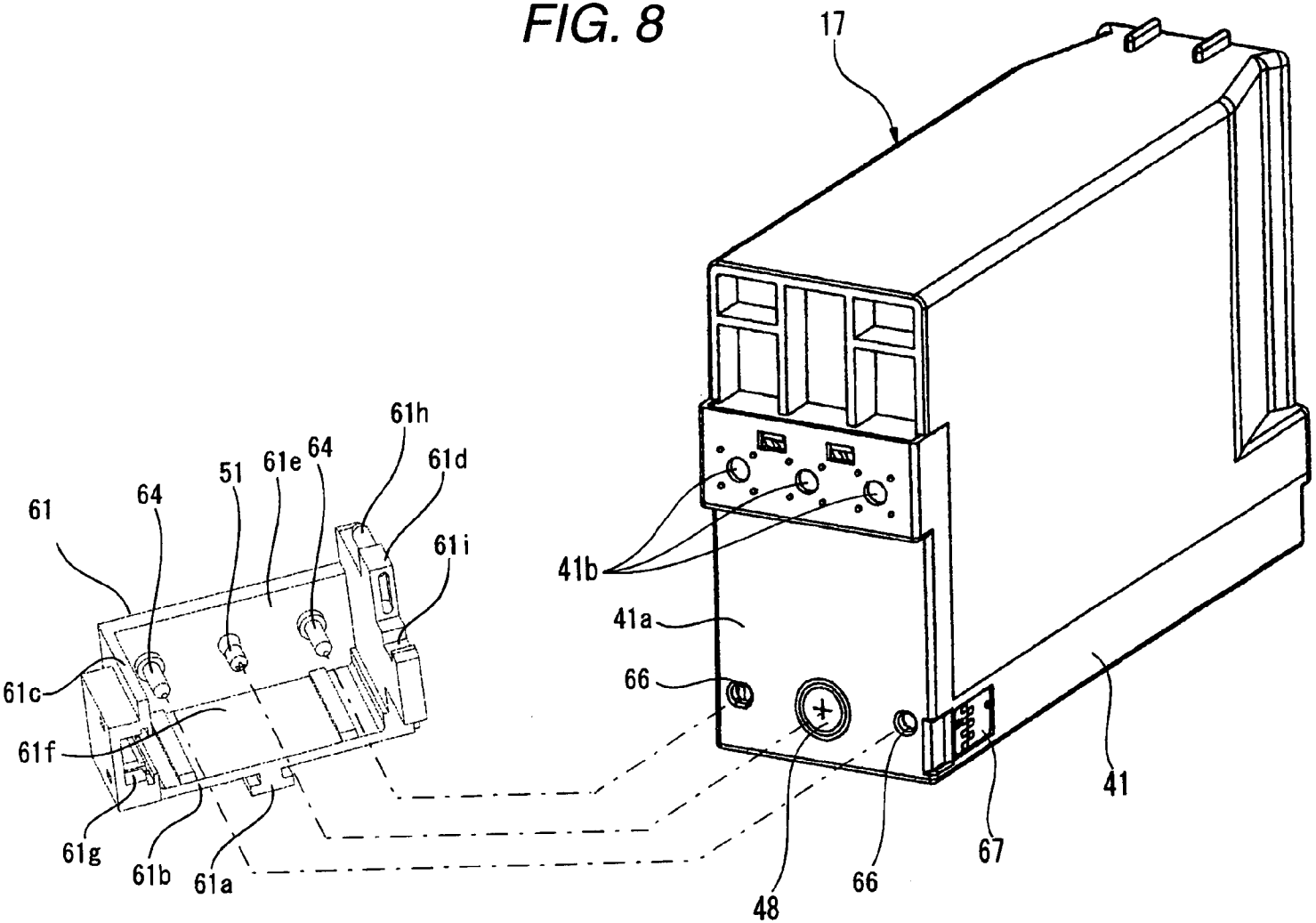
FIG. 8 is an exploded perspective view showing a connection structure of the ink cartridge to be mounted on the cartridge mounting portion shown in FIG. 2 and a waste ink introduction portion having the waste ink introduction needle to be connected to the ink cartridge.
Figure 9:
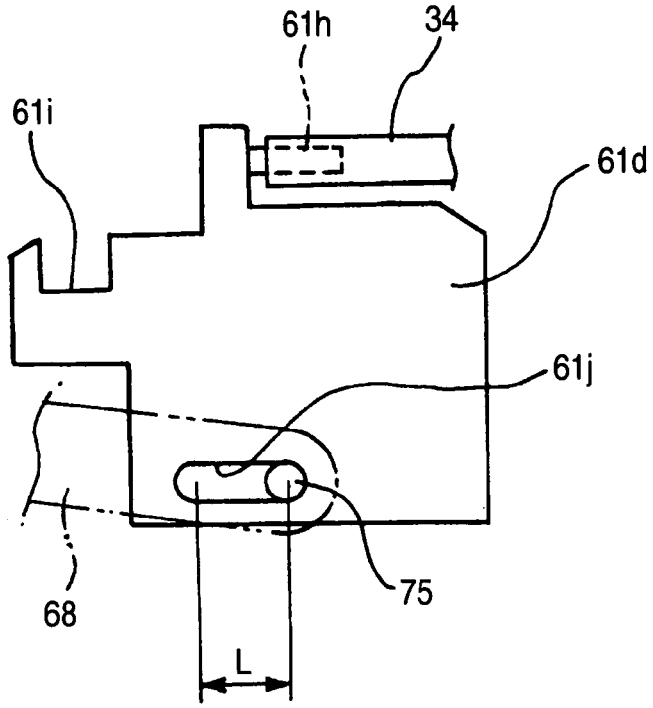
FIG. 9 is an explanatory view illustrating an engagement of the waste ink introduction portion and a cartridge attachment/detachment lever when the ink cartridge is located at a cartridge use position shown in FIG. 4.
Figure 10:
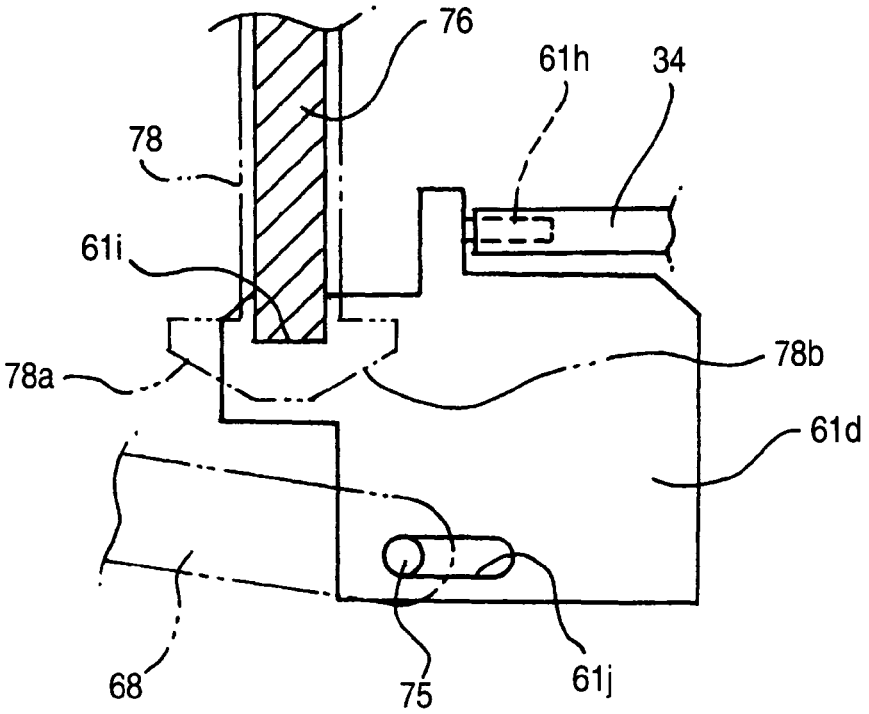
FIG. 10 is an explanatory view illustrating an engagement state of the waste ink introduction portion and the cartridge attachment/detachment lever when the ink cartridge is located at a cartridge replacement position shown in FIG. 6.
Figure 11:
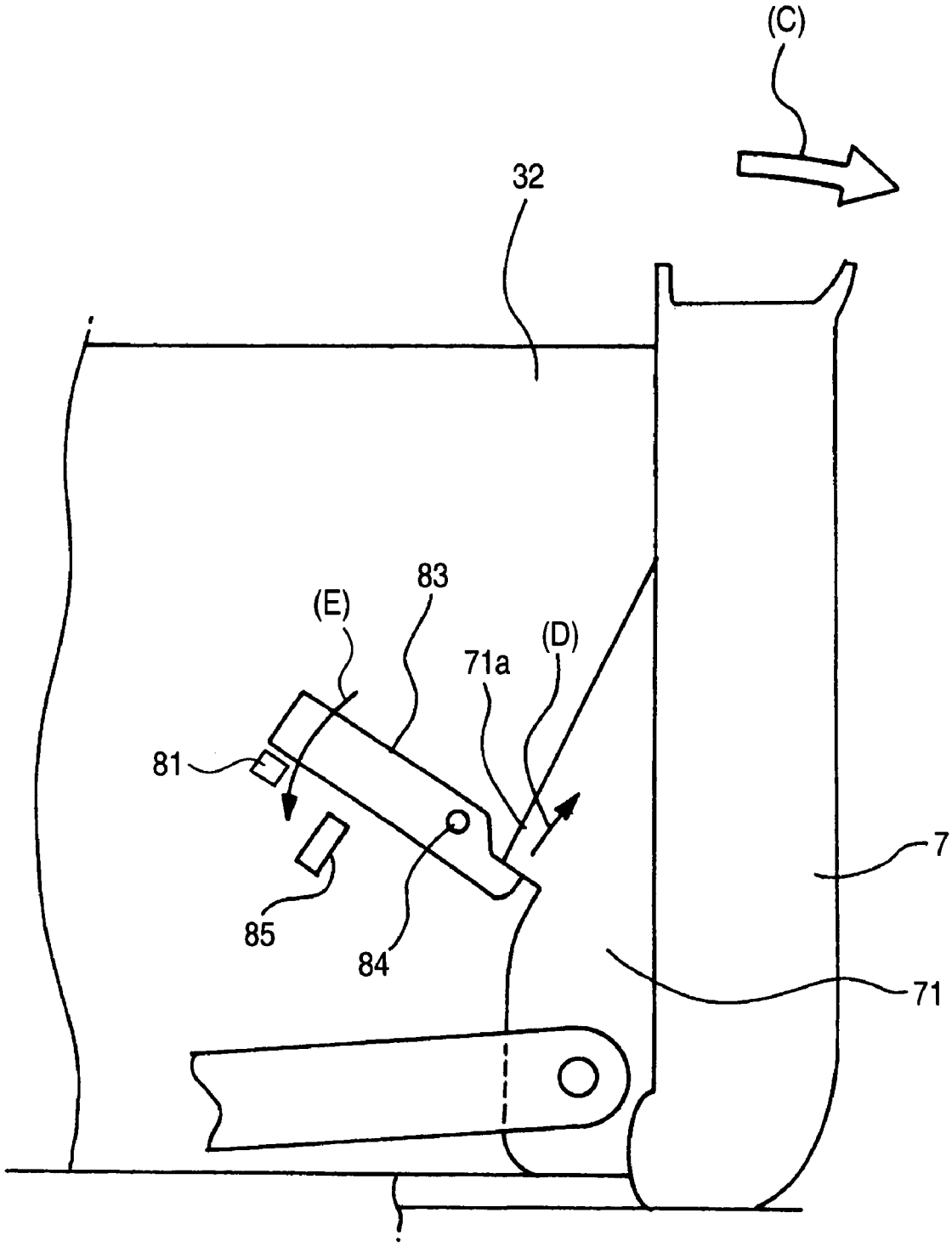
FIG. 11 is an explanatory view of a cartridge movement detecting sensor that is provided in the cartridge mounting portion.

FIG. 1 is an exterior perspective view of an ink jet recording apparatus according to an embodiment of the invention. FIG. 2 is a perspective view showing a state where a roll paper cover and a mounting portion opening/closing cover of the ink jet recording apparatus shown in FIG. 1 are opened. FIG. 3 is a perspective view showing a state where a case is removed from the ink jet recording apparatus shown in FIG. 2. FIG. 4 is a perspective view showing a state where a front upper panel, a case cover, and so on of the ink jet recording apparatus shown in FIG. 1 are removed. FIG. 5 is an expanded perspective view of a cartridge mounting portion shown in FIG. 4. FIG. 6 is a perspective view showing a state where a mounting portion opening/closing cover of the cartridge mounting portion shown in FIG. 5 is opened. FIG. 7 is a longitudinal cross-sectional view showing the positional relationship between an ink cartridge and a waste ink introduction needle to be connected to the ink cartridge. FIG. 8 is an exploded perspective view showing a connection structure of the ink cartridge to be mounted on the cartridge mounting portion shown in FIG. 2 and a waste ink introduction portion having the waste ink introduction needle to be connected to the ink cartridge. FIG. 9 is an explanatory view illustrating an engagement of the waste ink introduction portion and a cartridge attachment/detachment lever when the ink cartridge is located at a cartridge use position shown in FIG. 4. FIG. 10 is an explanatory view illustrating an engagement state of the waste ink introduction portion and the cartridge attachment/detachment lever when the ink cartridge is located at a cartridge replacement position shown in FIG. 6. FIG. 11 is an explanatory view of a cartridge movement detecting sensor that is provided in the cartridge mounting portion.

A printer (an ink jet recording apparatus) of this embodiment performs color printing on a roll paper using a plurality of color ink liquids. The printer is suitable for printing of discount coupons of a supermarket or the like.

As shown in FIG. 1, the printer 1 of this embodiment has a printer case 2 that has a front upper panel 2*a* and a case cover 2*b*. On the front surface of the printer case 2, a power switch 3, a roll paper cover 5, and a mounting portion opening/closing cover 7 are disposed. The roll paper cover 5 and the mounting portion opening/closing cover 7 are openably provided forward.

If the roll paper cover 5 is opened, as shown in FIG. 2, a paper accommodating portion 13 that accommodates a roll paper 11 serving as a printing paper is opened, and replacement of the roll paper 11 can be performed.

If the mounting portion opening/closing cover 7 is opened, as shown in FIG. 2, a cartridge mounting portion 15 is opened, and the attachment/detachment of the ink cartridge 17 of the cartridge mounting portion 15 can be performed.

The ink cartridge 17 accommodates a plurality of ink packs in a cartridge case 18. In case of the printer 1 of this embodiment, the ink cartridge 17 of the cartridge mounting portion 15 moves from a cartridge replacement position described below to a cartridge use position, in connection with the opening/closing operation of the mounting portion opening/closing cover 7.

As shown in FIG. 3, a carriage 23, on which a printing head is mounted, is provided above the paper accommodating portion 13 in the printer case 2. The carriage 23 is movably supported in a widthwise direction of the paper by a guide member 25 that extends along the widthwise direction of the roll paper 11. Further, the carriage 23 reciprocates in the widthwise direction of the roll paper 11 above a platen 28 by an endless belt 26*a* that extends in the widthwise direction of the roll paper 11 and a carriage motor 26*b* that drives the endless belt 26*a*.

As shown in FIG. 3, a wait position (home position) of the reciprocating carriage 23 is located above the cartridge mounting portion 15. Further, a cap (not shown) that covers ink nozzles of the printing head to be exposed at a bottom surface of the carriage 23, and an ink suction mechanism 29 mounted on the cap are provided below the wait position. The ink suction mechanism 29 has a waste ink feeding pump that press-feeds waste ink discharged by a head cleaning operation of the printing head or an ink filling operation into a waste ink storage space provided in the ink cartridge 17. Here, referring to FIG. 4, reference numeral 31 denotes a joint that is fixed to a casing 32 defining the cartridge mounting portion 15, and reference numerals 33 and 34 denote waste ink feeding tubes that feed waste ink ejected by the waste ink feeding pump to the ink cartridge 17. The waste ink feeding tubes 33 and 34 are flexible tubes. As shown in FIG. 4, the waste ink feeding tube 34 on the downstream side is flexibly cabled in a U shape such that a marginal length is secured so as to permit the movement operation at the time of replacement of the ink cartridge 17.

The configurations of the ink cartridge 17 and the cartridge mounting portion 15 will now be described.

As shown in FIG. 7, in the ink cartridge 17, an ink containing space 43 that accommodates the ink packs 42, and a waste ink storage space 44 that stores waste ink fed from the waste ink feeding pump through the waste ink feeding tubes 33 and 34 are formed in a cartridge case 41 that serves as a casing providing the appearance of the ink cartridge 17.

Each of the ink packs 42 has a cylindrical ink outlet port 45 for supplying an ink liquid to the outside in a side of a flexible pouch body storing the ink liquid. As shown in FIG. 7, the ink outlet port 45 has an on/off valve 45*a* that normally closes a flow passage. If an ink supply needle 46 provided in the cartridge mounting portion 15 is inserted into the ink outlet port 45, the on/off valve 45*a* is opened, and thus the ink liquid stored in the pouch body is supplied to the ink supply needle 46.

As shown in FIG. 8, the ink outlet port 45 of the ink pack 42 is aligned with and fixed to an opening 41*b* formed in a front wall 41*a* of the cartridge case 41. The ink containing space 43 of the ink cartridge 17 of this embodiment is configured to accommodate three ink packs 42 separately. Therefore, as shown in FIG. 8, three openings 41*b* individually facing the ink outlet ports 45 of the three ink packs 42 are formed in the front wall 41*a* of the cartridge case 41.

A waste ink introduction port 48 that receives waste ink into the waste ink storage space 44 from the outside is provided below the front wall 41*a* of the cartridge case 41. In the waste ink introduction port 48, a valve body 48*b* that closes the flow passage is pressed into contact with a ring-shaped mouth member 48*a* formed of an elastic material, such as rubber or the like, by a spring 48*c*. As shown in FIG. 7, if a waste ink introduction needle 51 provided in the cartridge mounting portion 15 is inserted and presses the valve body 48*b*, the flow passage is opened, and the waste ink introduction needle 51 and the waste ink storage space 44 are connected to each other. Then, the introduction of waste ink from the waste ink introduction needle 51 to the waste ink storage space 44 can be performed.

An ink absorption member 53 that absorbs introduced waste ink is installed in the waste ink storage space 44. As a material for the ink absorption member 53, a porous material, such as sponge or nonwoven fabric, or absorbent polymer can be used.

The ink cartridge 17 is inserted into and mounted on the cartridge mounting portion 15 from the side of the front wall 41*a* of the cartridge case 41 where the ink outlet ports 45 or the waste ink introduction port 48 is exposed.

As shown in FIG. 7, the ink supply needles 46 that are inserted into the ink outlet ports 45 and are connected to the ink packs 42, the waste ink introduction needle 51 that is inserted into the waste ink introduction port 48 and is connected to the waste ink storage space 44 are provided in the cartridge mounting portion 15.

As shown in FIG. 7, when the ink cartridge 17 is inserted to the cartridge use position of an inner part of the cartridge mounting portion 15, the ink supply needles 46 are provided in a structure 55 of the inner part of the cartridge mounting portion 15 so as to be connected to the ink outlet ports 45.

As shown in FIG. 3, an upper end of the structure 55 extends a traveling height of the carriage 23, and a flow passage that is connected to the ink supply needles 46 is formed in the structure 55. As shown in FIG. 3, the flow passage in the structure 55 is connected to one end of a flexible ink supply tube 57.

As shown in FIG. 3, the other end of the ink supply tube 57 is connected to a damper unit 58 provided on the carriage 23. The damper unit 58 is connected to a back pressure adjusting unit 59 connected to the printing head.

That is, in this embodiment, the ink liquid that is supplied from the ink pack 42 in the ink cartridge 17 to the ink supply needle 46 is supplied to the printing head while passing through the flow passage in the structure 55, the ink supply tube 57, the damper unit 58, and the back pressure adjusting unit 59.

The waste ink introduction needle 51 is provided in a waste ink introduction portion 61 shown in FIG. 8.

The waste ink introduction portion 61 is a mechanism having a guide portion 61*a* that is slidably fitted into a guide groove 62 (see FIG. 6) formed at a bottom portion of the cartridge mounting portion 15. If the guide portion 61*a* is fitted into the guide groove 62, as indicated by an arrow (A) in FIG. 6, the waste ink introduction portion 61 is movably provided in the cartridge mounting portion 15 along an insertion and extraction direction of the ink cartridge 17.

As shown in FIG. 8, the waste ink introduction portion 61 has a bottom wall portion 61*b* having the guide portion 61*a* provided at its bottom surface, left and right side walls 61*c* and 61*d* that are provided upright on both sides of the bottom wall portion 61*b*, and a rear wall portion 61*e* that is provided upright at a rear end of the bottom wall portion 61*b*. A space 61*f*, into which a lower portion of the front surface of the ink cartridge 17 is fitted, is defined by the individual wall portions 61*b* to 61*e*.

Two positioning pins 64 are provided in the rear wall portion 61*e* of the waste ink introduction portion 61, in addition to the waste ink introduction needle 51 that is inserted into and connected to the waste ink introduction port 48 of the ink cartridge 17. The two positioning pins 64 are disposed on both sides of the waste ink introduction needle 51. The two positioning pines 64 are fitted into positioning holes 66 formed in the front wall 41*a* of the ink cartridge 17, and thus positioning of the mounted ink cartridge 17 in a widthwise direction and a heightwise direction can be made.

A terminal mounting hole 61*g*, on which a connection terminal member connected to a control circuit of the printer 1 is mounted, is formed in the left wall 61*c* of the waste ink introduction portion 61. The connection terminal member mounted on the terminal mounting hole 61*g* electrically connects to a connection terminal of a memory device 67 provided in the side surface of the ink cartridge 17. Therefore, data can be read and written from and into the memory device 67 by the control circuit of the printer.

A tube connection port 61*h*, an engagement groove 61*i*, and a slotted lever connection portion 61*j* (see FIG. 9) are provided in the right wall 61*d* of the waste ink introduction portion 61. The tube connection port 61*h* is connected to the waste ink feeding tube 34. The engagement groove 61*i* positions and fixes the waste ink introduction portion 61 at the cartridge replacement position when the waste ink introduction portion 61 is extracted from the cartridge use position to the cartridge replacement position, together with the ink cartridge 17. The lever connection portion 61*j* is connected to a connection pin 75 that is provided at a front end of a cartridge attachment/detachment link 68 in order to move the waste ink introduction portion 61 from the cartridge use position to the cartridge replacement position, together with the ink cartridge 17.

Though not shown, a flow passage that connects the waste ink introduction needle 51 to the tube connection port 61*h* is formed in the rear wall portion 61*e* and the right wall 61*d* of the waste ink introduction portion 61.

That is, as shown in FIG. 5, when the ink cartridge 17 is mounted on the cartridge mounting portion 15, the waste ink storage space 44 of the ink cartridge 17, to which the waste ink introduction needle 51 is connected, is connected to the waste ink feeding pump of the ink suction mechanism 29 through the flow passage in the waste ink introduction portion 61, the waste ink feeding tube 34, the joint 31, the waste ink feeding tube 33. Then, waste ink that is fed by the waste ink feeding pump at the time of the head cleaning operation of the printing head or the ink filling operation is introduced into the waste ink storage space 44.

As shown in FIGS. 5 and 6, a base end of the cartridge attachment/detachment link 68 is rotatably connected to the cartridge attachment/detachment lever 71, which is displaced (rotates) integrally with the mounting portion opening/closing cover 7, through a pin 72. Accordingly, at the time of an opening operation of the mounting portion opening/closing cover 7, the cartridge attachment/detachment link 68 is extracted forward by the cartridge attachment/detachment lever 71 that rotates integrally with the mounting portion opening/closing cover 7. Then, the ink cartridge 17 is extracted forward to the cartridge replacement position integrally with the waste ink introduction portion 61 since the connection pin 75 at the front end of the cartridge attachment/detachment link 68 is connected to the lever connection portion 61*j*.

In this embodiment, the lever connection portion 61*j* is formed in a slot shape such that the connection pin 75 is movably set by a predetermined length L along the moving direction of the ink cartridge 17. With the slot, even though the cartridge attachment/detachment link 68 moves in the extraction direction of the ink cartridge 17, the connection pin moves within the slot at the beginning of the movement of the cartridge attachment/detachment link 68, and thus the waste ink introduction portion 61 does not move.

That is, in this embodiment, as regards the rotation operation of the cartridge attachment/detachment lever 71 when the ink cartridge 17 moves from the cartridge use position to the cartridge replacement position, a predetermined operation range at the beginning of the rotation is set so as not to be involved in the movements of the ink cartridge 17 and the waste ink introduction portion 61.

Meanwhile, an anchoring cam 78 that anchors the waste ink introduction portion 61 at the cartridge replacement position is vertically movably provided in the casing 32 that defines the cartridge mounting portion 15. Specifically, as shown in FIG. 10, the anchoring cam 78 has cam surfaces 78*a* and 78*b* at its lower end. The cam surfaces 78*a* and 78*b* are brought into contact with a plate cam 77 (see FIG. 6) and are biased upward by the plate cam 77. On both side surfaces of the anchoring cam 78, protruding portions are provided to protrude from the side surfaces. The protrusions are fitted into and vertically movably supported by a U groove of a support portion that is bent and erected from the casing 32 defining the cartridge mounting portion 15, and are biased downward by a spring member (not shown).

As shown in FIG. 10, the anchoring cam 78 has an engagement piece 76 (locking mechanism) that is engaged with the engagement groove 61*i* (locking mechanism) of the waste ink introduction portion 61. The engagement piece 76 is formed integrally with the anchoring cam 78 on its rear surface. That is, the engagement piece 76 and the anchoring cam 78 integrally move up and down. When the anchoring cam 78 is brought into contact with the plate cam 77 and the anchoring cam 78 ascends, the engagement piece 76 also ascends together with the anchoring cam 78.

When the ink cartridge 17 is separated from the cartridge use position by the forward movement of the cartridge attachment/detachment link 68, the connection of the ink supply needle 46 and the ink cartridge 17 is released according to the movement of the ink cartridge 17 since the ink supply needle 46 is provided in the structure 55 of the inner part of the cartridge mounting portion 15.

If the ink cartridge 17 is extracted to the cartridge replacement position, the plate cam 77 slides on the cam surface 78*b* of the anchoring cam 78, and the anchoring cam 78 moves upward. Then, the engagement piece 76 moves above an end portion of the waste ink introduction portion 61 where the engagement groove 61*i* is formed. Subsequently, if the cartridge attachment/detachment link 68 moves forward, the anchoring cam 78 descends such that the cam surface 78*a* is brought into contact with the plate cam 77. Accordingly, as shown in FIG. 10, the engagement piece 76 is engaged with the engagement groove 61*i* of the waste ink introduction portion 61, and the waste ink introduction portion 61 is fixed so as not to move forward and backward. In this state, if the ink cartridge 17 is extracted forward, the waste ink introduction needle 51 and the ink cartridge 17 are disconnected, and the ink cartridge 17 is completely removed from the cartridge mounting portion 15.

In a state where the waste ink introduction portion 61 is fixed by the engagement piece 76, if a new ink cartridge 17 is press-attached to the waste ink introduction portion 61, the waste ink introduction needle 51 and the positioning pins 64 provided in the waste ink introduction portion 61 are fitted into the waste ink introduction port 48 and the positioning holes 66 of the ink cartridge 17, such that the ink cartridge 17 and the waste ink introduction port 48 are connected to each other. In this case, the engagement groove 61*i* and the engagement piece 76 are engaged with each other, the waste ink introduction portion 61 does not move, and the mounting portion opening/closing cover 7 is not closed. Therefore, there is no case where a user's hand is caught by the mounting portion opening/closing cover 7.

When the mounting portion opening/closing cover 7 is opened, and the waste ink introduction portion 61 is fixed at the cartridge replacement position, as shown in FIG. 10, the connection pin 75 of the cartridge attachment/detachment link 68 is disposed at a front end of the slotted lever connection pin 61*j*. In this state, even though the opening operation of the mounting portion opening/closing cover 7 starts again and the cartridge attachment/detachment link 68 starts to move backward by the rotation of the cartridge attachment/detachment lever 71, the connection pin 75 merely moves within the slot at the beginning of the rotation, and thus the waste ink introduction portion 61 does not move.

If the mounting portion opening/closing cover 7 rotates by a predetermined angle from the opened state in a closing direction, as shown in FIG. 6, the plate cam 77 that is formed at an upper edge of the cartridge attachment/detachment link 68 is brought into contact with the anchoring cam 78 by the movement of the cartridge attachment/detachment link 68 connected to the cartridge attachment/detachment lever 71. Then, the anchoring cam 78 is pushed up as indicated by an arrow (B).

Therefore, if the mounting portion opening/closing cover 7 is closed by a predetermined angle, and the plate cam 77 pushes up the anchoring cam 78, the engagement piece 76 and the engagement groove 61*i* shown in FIG. 10 are disengaged from each other, and the waste ink introduction portion 61 can move to the cartridge replacement position.

If the mounting portion opening/closing cover 7 is completely closed, as shown in FIG. 5, the waste ink introduction portion 61 and the ink cartridge 17 are positioned at the cartridge use position, and the ink supply needles 46 are connected to the ink outlet ports 45 of the ink cartridge 17.

In this embodiment, as shown in FIG. 11, a cartridge movement detecting sensor 81 that detects the movement operation of the ink cartridge 17 from the cartridge use position to the cartridge replacement position on the basis of the rotation operation of the cartridge attachment/detachment lever 71 is provided on the left surface (FIG. 5 shows the right surface) of the casing 32 that defines the cartridge mounting portion 15.

The cartridge movement detecting sensor 81 is a proximity sensor that detects the occurrence of the movement by the displacement of an end portion of an arm 83, which pivots according to the rotation of the cartridge attachment/detachment lever 71 rotating integrally with the mounting portion opening/closing cover 7.

The arm 83 is pivotably supported around a fulcrum 84 on the casing 32. One end of the arm 83 is brought into contact with a pressing portion 71*a* of the cartridge attachment/detachment lever 71, such that a rotation in a counterclockwise direction in the drawing is regulated. The other end of the arm 83 extends to a position close to the cartridge movement detecting sensor 81.

In FIG. 11, if the cartridge attachment/detachment lever 71 rotates in a direction of an arrow (D) by the opening operation of the mounting portion opening/closing cover 7 indicated by an arrow (C), the arm 83 that is pressed by the pressing portion 71*a* of the cartridge attachment/detachment lever 71 rotates in a direction of an arrow (E) in the drawing around the fulcrum 84 on the casing 32. On the basis of the displacement of the other end of the arm 83 at that time, the cartridge movement detecting sensor 81 detects that the extraction operation of the ink cartridge 17 starts.

Subsequently, if the movement of the ink cartridge 17 is detected by the cartridge movement detecting sensor 81, the operation of the waste ink feeding pump of the ink suction mechanism 29 stops.

Moreover, in this embodiment, a stopper 85 is provided to regulate a rotation range of the arm 83 such that the arm 83 does not rotate more than it should, when the mounting portion opening/closing cover 7 is opened and the pressing portion 71*a* is completely separated from the arm 83. Then, the arm 83 rotates to the position shown in FIG. 11 by the pressing portion 71*a* at the time of the closing operation of the mounting portion opening/closing cover 7.

In the printer 1 of this embodiment described above, at the time of the replacement of the ink cartridge 17, first, by the rotation operation of the cartridge attachment/detachment lever 71, the used ink cartridge 17 mounted on the cartridge mounting portion 15 is extracted from the cartridge use position where the ink supply needles 46 of the cartridge mounting portion 15 are connected to the ink outlet ports 45 to the cartridge replacement position where the connection of the ink outlet ports 45 and the ink supply needles 46 is released.

However, even though the ink cartridge 17 moves to the cartridge replacement position, the waste ink introduction needle 51 that introduces waste ink into the waste ink storage space 44 of the ink cartridge 17 moves integrally with the ink cartridge 17 to the cartridge replacement position. Accordingly, unless the removal operation of the ink cartridge 17 from the cartridge replacement position is made, there is no case where the waste ink introduction needle 51 is separated from the ink cartridge 17.

That is, even though the ink cartridge 17 starts to move from the cartridge use position toward the cartridge replacement position for the replacement of the ink cartridge 17, there is no case where the waste ink introduction needle 51 is separated from the ink cartridge 17 immediately after the ink cartridge 17 starts to move. Accordingly, the connection state of the ink cartridge 17 and the waste ink introduction needle 51 is maintained until the ink cartridge 17 is removed from the cartridge replacement position.

Therefore, a required time until the connection of the ink cartridge 17 and the waste ink introduction needle 51 is released can be significantly increased, as compared with the related art in which the connection of the ink cartridge 17 and the waste ink introduction needle 51 is released immediately after the ink cartridge 17 starts to move from the cartridge use position to the cartridge replacement position.

In this embodiment, with the cartridge movement detecting sensor 81 that detects the rotation of the cartridge attachment/detachment lever 71, when the ink cartridge 17 starts to move, the waste ink feeding pump rapidly stops.

For this reason, even though the replacement of the ink cartridge 17, which is receiving waste ink from the waste ink feeding pump, starts during the operation of the waste ink feeding pump, a sufficient time elapsed from a time when the operation of the waste ink feeding pump stops until the ink cartridge 17 reaches the cartridge replacement position and is removed from the cartridge replacement position is allocated to a time for collecting waste ink remaining in a flow passage from the waste ink feeding pump to the waste ink introduction needle 51 into the waste ink storage space 44.

Therefore, there is no case where waste ink remaining in the flow passage is not collected and leaks into the apparatus, and thus the inside of the printer can be prevented from being stained due to waste ink.

In the printer 1 of this embodiment, the stop operation of the waste ink feeding pump is rapidly made simultaneously with the start of the rotation of the cartridge attachment/detachment lever 71 by the action of the cartridge movement detecting sensor 81. Meanwhile, the actual movement of the ink cartridge 17 to the cartridge replacement position starts later than the rotation of the cartridge attachment/detachment lever 71 by an idle time set in the lever connection portion 61*j*. Therefore, a required time until the connection of the ink cartridge 17 and the waste ink introduction needle 51 is released is increased.

That is, a time for collecting waste ink remaining in the flow passage from the waste ink feeding pump to the waste ink introduction needle 51 into the waste ink storage space 44 of the ink cartridge 17 can be increased. As a result, waste ink remaining in the flow passage can be reliably collected, and reliability for a stain prevention effect in the printer due to waste ink can be improved.

In the related art printer, the replacement operation of the ink cartridge requires many actions of (a) opening the mounting portion opening/closing cover and opening the front surface of the cartridge mounting portion, (b) extracting the mounted ink cartridge to the cartridge replacement position where the connection of the ink outlet port of the ink cartridge and the ink supply needle of the cartridge mounting portion is released, (c) replacing the ink cartridge extracted to the cartridge replacement position with a new ink cartridge and returning the new ink cartridge to the cartridge use position where the ink outlet port is connected to the ink supply needle of the cartridge mounting portion, and (d) closing the mounting portion opening/closing cover.

In contrast, in the printer of this embodiment, the cartridge attachment/detachment lever 71 is incorporated into the mounting portion opening/closing cover 7, and the opening/closing operation of the mounting portion opening/closing cover 7 includes the rotation operation of the cartridge attachment/detachment lever 71. Accordingly, the replacement operation of the ink cartridge 17 requires two actions of (a) opening the mounting portion opening/closing cover 7 and extracting the ink cartridge 17 mounted on the cartridge mounting portion 15 to the cartridge replacement position, and (b) replacing the ink cartridge 17 extracted to the cartridge replacement position with a new ink cartridge 17 and closing the mounting portion opening/closing cover 7. Therefore, as compared with the related art in which the opening/closing operation of the mounting portion opening/closing cover 7 and the rotation operation of the cartridge attachment/detachment lever 71 are separately performed, the replacement of the ink cartridge can be performed by a small amount of action, and a handling property can be improved.

Moreover, the kind or arrangement of the cartridge movement detecting sensor that detects the start of the operation for the replacement of the ink cartridge is not limited to the above-described embodiment. As a sensor, a sensor that optically detects operations of an operating portion in a contactless manner can be used as well as the proximity sensor. Further, the start of the operation for the replacement of the ink cartridge may be detected on the basis of the opening operation the mounting portion opening/closing of the cover 7, not the operation of the cartridge attachment/detachment lever 71. Further, the configuration, such as the shape or the like, of the waste ink storage space 44 provided in the ink cartridge 17 is not limited to the above-described embodiment.

The invention can be most effectively applied to a case where, according to mounting accuracy of the sensor that stops the operation of the waste ink feeding pump, the waste ink feeding pump stops when the waste ink introduction needle is separated. Further, the connection to the ink cartridge is described by way of the waste ink introduction needle and the ink supply needle, but the invention is not limited to this configuration. For example, the connection to the ink cartridge may be made by pressing porous materials. In this case, ink may flow using capillary force of the porous materials.

Moreover, the cartridge attachment/detachment lever is not limited to the rotatable cartridge attachment/detachment lever as the above-described embodiment and thus a pullout cartridge attachment/detachment lever may be used.

What is claimed is:

1. An ink jet recording apparatus comprising:

a cartridge mounting portion, on which an ink cartridge having a waste ink containing portion containing a waste ink can be mounted;

a waste ink introduction portion, adapted to connect to a waste ink introduction port of the waste ink containing portion of the ink cartridge so as to introduce the waste ink;

a waste ink introduction portion holder, supporting the waste ink introduction portion; and a cartridge moving mechanism, operable to move the ink cartridge to a cartridge replacement position, located on an outside of the cartridge mounting portion where the ink cartridge can be attached to or detached from the cartridge mounting portion, and a cartridge use position located on an inside of the cartridge mounting portion, wherein the waste ink introduction portion includes a waste ink introduction portion holder moving mechanism that moves the waste ink introduction portion holder integrally with the ink cartridge between the cartridge replacement position and the cartridge use position while the waste ink introduction portion is connected to the waste ink introduction port.

2. The ink jet recording apparatus according to claim 1, wherein the waste ink introduction portion has a waste ink introduction needle adapted to be inserted into the waste ink introduction port.

3. The ink jet recording apparatus according to claim 1, wherein the cartridge moving mechanism has a locking mechanism fixing the waste ink introduction portion holder at the cartridge replacement position.

4. The ink jet recording apparatus according to claim 1, wherein said waste introduction portion includes an engagement groove that positions and fixes said waste introduction portion when the waste introduction portion is extracted from the cartridge use position to the cartridge replacement position.

5. The ink jet recording apparatus according to claim 1, wherein said waste ink introduction portion holder moving mechanism includes a slotted lever connection portion connected to a connection pin provided in a cartridge attachment/detachment link in order to move the waste introduction portion together with the ink cartridge.

6. The ink jet recording apparatus according to claim 5, wherein said slotted lever connection portion includes a slot having a predetermined length such that said connection pin moves with said slot, and said waste ink introduction portion does not move.

7. The ink jet recording apparatus according to claim 5, wherein said cartridge mounting portion includes an anchoring cam that anchors the waste introduction portion at the cartridge replacement position.

8. The ink jet recording apparatus according to claim 7, wherein said anchoring cam includes cam surfaces that contact a plate cam formed on said cartridge attachment/detachment link.

9. The ink jet recording apparatus according to claim 8, wherein said anchoring cam includes an engagement piece that is engageable with an engagement groove formed in said waste introduction portion, wherein said waste in introduction portion is fixed when said cartridge attachment/detachment link moves forward.

10. The ink jet recording apparatus according to claim 8, wherein when said cover is closed by a predetermined angle, said plate cam pushes up on said anchoring cam, and said engagement piece and said engagement groove become disengaged from each other.

11. An ink jet recording apparatus comprising:

an ink supply portion, adapted to connect to an ink outlet port of an ink cartridge so as to supply ink of the ink cartridge to a printing head;

a waste ink introduction portion, adapted to connect to a waste ink introduction port of the ink cartridge;

a waste ink introduction portion holder, supporting the waste ink introduction portion; and a cartridge moving mechanism, operable to move the ink cartridge from a cartridge replacement position where the ink outlet port and the ink supply portion are disconnected from each other while the waste ink introduction portion is connected to the waste ink introduction port, to a cartridge use position where the ink outlet port and the ink supply portion are connected to each other, or from the cartridge use position to the cartridge replacement position, wherein the waste ink introduction portion includes a waste ink introduction portion holder moving mechanism that moves the waste ink introduction portion holder integrally with the ink cartridge between the cartridge replacement position and the cartridge use position while the waste ink introduction portion is connected to the waste ink introduction port.

12. The ink jet recording apparatus according to claim 11, wherein the ink supply portion has an ink supply needle adapted to be inserted into the ink outlet port.

13. The ink jet recording apparatus according to claim 11, wherein the waste ink introduction portion has a waste ink introduction needle adapted to be inserted into the waste ink introduction port.

14. The ink jet recording apparatus according to claim 11, wherein the cartridge moving mechanism has a cartridge attachment/detachment lever operable to move the waste ink introduction portion holder.

15. The ink jet recording apparatus according to claim 14, further comprising:

a cartridge movement detecting sensor operable to detect a movement operation of the ink cartridge from the cartridge use position to the cartridge replacement position based on a displacement operation of the cartridge attachment/detachment lever, wherein when the movement operation of the ink cartridge is detected by the cartridge movement detecting sensor, an operation of a waste ink feeding pump to feed the waste ink to the waste ink introduction needle stops.

16. The ink jet recording apparatus according to claim 14, wherein a displacement operation of the cartridge attachment/detachment lever when the ink cartridge moves from the cartridge use position to the cartridge replacement position, includes a predetermined operation range at the beginning thereof set such that the displacement operation does not move the ink cartridge and the waste ink introduction portion holder.

17. The ink jet recording apparatus according to claim 14, further comprising: a mounting portion opening/closing cover which openably covers a front surface of the cartridge mounting portion, wherein the displacement operation of the cartridge attachment/detachment lever is in connection with an opening/closing operation of the mounting portion opening/closing cover.

18. The ink jet recording apparatus according to claim 11, wherein the cartridge moving mechanism has a locking mechanism fixing the waste ink introduction portion holder at the cartridge replacement position.

* * * * *